US005546498A

United States Patent [19]

Sereno

[11] Patent Number: 5,546,498

[45] Date of Patent: Aug. 13, 1996

[54] METHOD OF AND DEVICE FOR QUANTIZING SPECTRAL PARAMETERS IN DIGITAL SPEECH CODERS

[75] Inventor: Daniele Sereno, Turin, Italy

[73] Assignee: Sip - Societa Italiana per l'esercizio Delle Telecomunicazioni S.p.A., Turin, Italy

[21] Appl. No.: 243,297

[22] Filed: May 17, 1994

[30] Foreign Application Priority Data

Jun. 10, 1993 [IT] Italy ..... 93A000420

[51] Int. Cl.[6] ..... G10L 3/02

[52] U.S. Cl. ..... 395/2.38; 395/2.31; 395/2.25; 395/2.29; 395/2.72

[58] Field of Search ..... 381/36–40; 395/2.25–2.34, 395/2.38, 2.39, 2.71–2.73

[56] References Cited

U.S. PATENT DOCUMENTS

| | | | |
|---|---|---|---|
| 4,932,061 | 6/1990 | Kroon et al. | 395/2.32 |
| 5,208,862 | 5/1993 | Ozawa | 381/40 |
| 5,351,338 | 9/1994 | Wigren | 395/2.28 |

FOREIGN PATENT DOCUMENTS

| | | | |
|---|---|---|---|
| 0195487 | 9/1986 | European Pat. Off. | G10L 9/14 |
| 0337636 | 10/1989 | European Pat. Off. | G10L 7/02 |
| WO94/01860 | 1/1994 | WIPO | G10L 9/08 |

OTHER PUBLICATIONS

"A 5.85 kb/s Celp Algorithm For Celular Applications", W. Bastiaan Kleijn, Peter Kroon (USA), Luca Cellario and Daniele Sereno (Italy), 1993 IEEE, pp. II–596 to II–599.

"A Long History Quantization Approach To Scalar And Vector Quantization . . . ", C. S. Xydeas & K. K. M. So, Department of Elect. Engin. University of Manchester, pp. II–1 to II4, 1993 IEEE.

"Low Bit–Rate Quantization Of LSP Parameters Using Two–Dimension Differention Coding", Chih–Chung Kuo, Fu–Rong Jean, Hsiao–Chuan Wang; Dept. of Electr. Engin. Hsinchu, Taiwan; pp. I–97 to I–100.

*Primary Examiner*—Kee Mei Tung
*Attorney, Agent, or Firm*—Herbert Dubno

[57] ABSTRACT

A method of and a device for speech signal digital coding are described, where spectral parameters are quantized at each frame in order to exploit the actual correlation inside a frame or between contiguous frames. The quantization devices (DQ) recognize strongly correlated signal periods by using a first set of indexes ($j_1$), representing the parameters and provided by the spectral analysis circuits (ABT, ALT), and in these periods they convert the same indexes into a second set of indexes (j4) which can be coded with a lower number of bits and which is inserted into the coded signal in place of the first set.

11 Claims, 3 Drawing Sheets

METHOD OF AND DEVICE FOR QUANTIZING SPECTRAL PARAMETERS IN DIGITAL SPEECH CODERS

SPECIFICATION

1. Field of the Invention

The present invention relates to digital speech coders and, more particularly, to a method and a device for the quantization of spectral parameters in these coders.

2. Background of the Invention

Speech coding systems yielding a high quality coded speech at a low bit rate are becoming more and more interesting. A reduction in bit rate allows for example devoting more resources to the redundancy required for protecting information in fixed rate transmissions, or reducing average rate in variable rate transmission.

Techniques enabling the attainment of this purpose are particularly the linear prediction coding (LPC) techniques, using speech spectral characteristics.

For reducing bit rate it has already been proposed to use the correlation existing between certain spectral parameters within a signal frame or between successive signal frames, to avoid transmitting information which can easily be predicted and hence reconstructed at the receiver. Examples of these proposals are described in the paper "Low bit-rate quantization of LSP parameters using two-dimensional differential coding" by Chih-Chung Kuo et al., ICASSP-92, S. Francisco, U.S.A., 23–26 Mar. 1992, pages I-97 to I-100, and "A long history quantization approach to scalar and vector quantization of LSP coefficients", by C. S. Xideas and K. K. M. So, ICASSP-93, Minneapolis, U.S.A., 27–30 Apr. 1993, pages II-1 to II-4.

The first paper is based on linear prediction of the line spectrum pairs within the same frame and between successive frames, so that only prediction residuals are to be quantized and coded. The possibility of scalar or vector quantization of these residuals is provided. The quantization law is fixed, and so it can take into account only an "average" correlation which is a limited improvement with respect to the conventional technique.

The second paper discloses quantization of a group of parameters related to a certain frame with a codebook comprising the N groups of decoded parameters relevant to the N preceding frames or to a set of N frames extracted from the previous frames, so that only the particular group index is to be transmitted. In this case too scalar or vector quantization can be used. The drawback of this technique is that the use of an adaptive codebook, based on signal decoding results, makes the coder particularly sensitive to channel errors.

OBJECT OF THE INVENTION

The object of the invention is to provide a quantization technique, based on a particular signal classification, which uses an effective correlation, not only an average correlation, and which is scarcely sensitive to channel errors.

SUMMARY OF THE INVENTION

The invention provides a method of speech signal digital coding, where the signal is converted into a sequence of digital signals divided into frames with a preset number of samples and is subjected to a spectral analysis for generating at least a group of spectral parameters which are quantized and transformed into a first set of indexes, and in which moreover, during the coding phase, speech periods with high correlation are recognized at each frame starting from the indexes of the first set, and for these periods, the first set of indexes is converted into a second set, which can be coded with a lower number of bits than that necessary for coding the first set, and the second set of indexes is inserted into the coded signal together with a signalling indicating that conversion has taken place, while for the other periods the first set of indexes is inserted into the coded signal.

The invention also provides a device for realizing the method which comprises, on the coding side:

means for: recognizing frames in which the speech signal presents a high correlation, starting from the indexes of the said first set; converting, for these frames, the first set of indexes into a second set of indexes, which can be coded with a number of bit lower than that required for coding the first set of indexes; and signalling to a decoder that conversion has taken place; and means for providing the coding units with the second set of indexes in place of the first set in the frames with high correlation.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
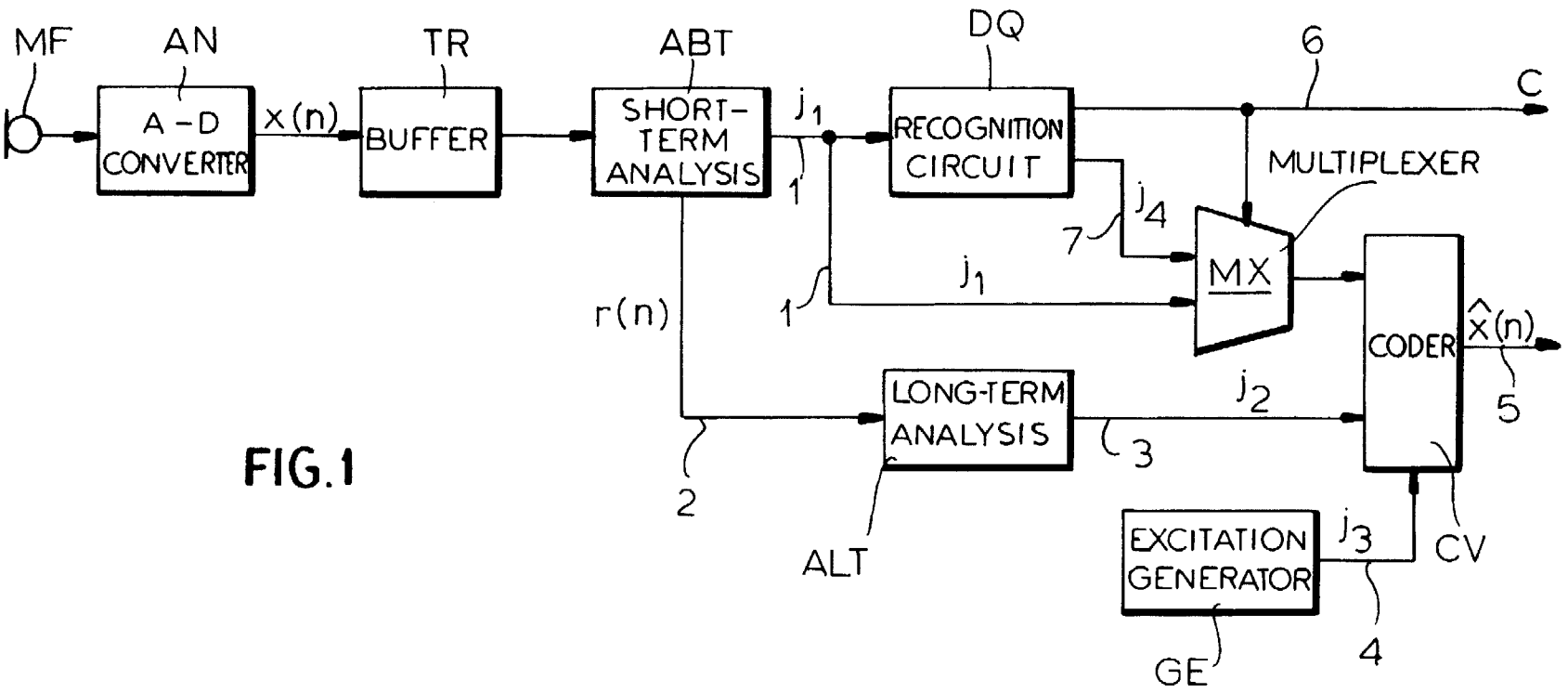
FIG. 1 is a schematic diagram of the transmitter of a coder using the invention.

FIG. 1 shows the transmitter of an LPC coder in the more general case in which short-term and long-term spectral characteristics of speech signal are used. The speech signal generated e.g. by a microphone MF is converted by an analog-to-digital converter AN into a sequence of digital samples x(n), which is then divided into frames with a preset length in a buffer TR. The frames are sent to short-term analysis circuits, schematized by block ABT, which incorporate units for estimation and quantization of short-term spectral parameters and the linear prediction filter which generates the short-term prediction residual signal. Spectral parameters can be linear prediction coefficients, line spectrum pairs (LSP) or any other set of variables representing speech signal short-term spectral characteristics. The type of parameters used and the type of quantization to which they are subjected bears no interest for the present invention; by way of example we will however refer to line spectrum pairs, assuming that 9 or 10 coefficients are generated for a frame of 20 ms and are scalarly quantized. As a result of quantization on a connection 1 there is a first group of indexes $j_1$, which can be directly provided to coding units CV or subjected to further processing, as it will be seen later.

The short-term prediction residual r(n), present on output 2 of ABT, is provided to long-term analysis circuits ALT, which compute and quantize a second group of parameters (more particularly a lag d, linked to the pitch period, and a coefficient b of long-term prediction) and generate a second group of indexes $j_2$, provided to coding units CV through connection 3. Finally, an excitation generator GE sends to coding units CV, through connection 4, a third group of indexes $j_3$, which represent information related to the excitation signal to be used for the current frame. Coding units CV emit on connection 5 the coded signal $\hat{x}(n)$ containing information about short-term and long-term analysis parameters and about excitation.

It is known that under certain conditions, more particularly for highly voiced sounds, spectral characteristics of speech change at a rate that is lower than the frame frequency and the spectral shape may vary very little for several contiguous frames. This results in a slight modification of a few line spectrum coefficients.

According to the invention this fact is exploited by providing, between short-term analysis circuits ABT and coding units CV, a device DQ for recognizing correlation and for quantizing spectral parameters, which allows the coder to operate in a different mode depending on whether the speech segment presents a high short-term correlation or does not provide such correlation. Device DQ uses indexes $j_1$ for recognizing highly correlated sections and emits on output 6 a flag C which is at 1 for example in case of a correlated signal and which is transmitted also to the receiver. In case of a correlated signal, indexes $j_1$ are transformed into a group of indexes $j_4$, which can be coded with a bit number of bit lower than that required for coding indexes $j_1$ and which are presented on connection 7. A multiplexer MX, controlled by flag C, transfers to coding units CV indexes $j_1$ if the signal is not correlated, or indexes $j_4$ if the signal is correlated.

More particularly, at each frame, circuit DQ computes the difference between each of the indexes $j_1$ and the value it had in the previous frame, and sets flag C at 1 if the absolute value of all the differences $\delta_i$ is lower than a preset threshold s. In a preferred embodiment, |s|=2. If C is 1, a vector quantization of values $\delta_i$, suitably grouped into subsets, is carried out. If P is the number of values in a subset, $N=(2s+1)^P$ value combinations exist, and for each subset the index corresponding to the particular combination is transmitted to coding units CV. It must be specified that, for subsets of equal size, an index corresponding to line spectrum pair coefficients with the highest serial number can be neglected when computing the differences. For example, if 10 indexes $j_1$ are used, differences are computed only for the first 9. It is however possible to have unequal sized subsets.

With reference to the example considered, indexes $j_1$ are divided into three subsets of 3 indexes each and each of these subsets is represented by a respective index j(4,0), j(4,1), j(4,2). Since the considered interval includes 5 values of the difference, $5^3=125$ terns of values are possible, and each index $j_4$ can be coded in CV with 7 bits, for a total of 21 bits. It can also be noticed that the 7 bits allow the coding of 128 value combinations. The three combinations which do not correspond to any possible tern of difference values can be used at the receiver for recognizing transmission errors.

By way of comparison, a coder for low bit rate transmissions which does not use the invention, described in the paper "A 5.85 kb/s CELP algorithm for cellular applications", presented by the inventor et al. at ICASSP-93, represents short-term analysis parameters with 10 coefficients, each one coded with 3 bits, and then demands 30 bits per frame. Taking into account that the invention requires the transmission of 1 bit for coding flag C, for speech periods in which the signal can be considered as correlated (according to the evaluation criterion here described) and which make up in the average 40% of a conversation, the invention allows a bit rate reduction, for spectral parameters, greater than 25%. Average bit rate reduction is therefore significant. The use of 9 spectral parameters instead of 10 in these periods does not imply a significant degradation of the coded signal.

Figure 2:
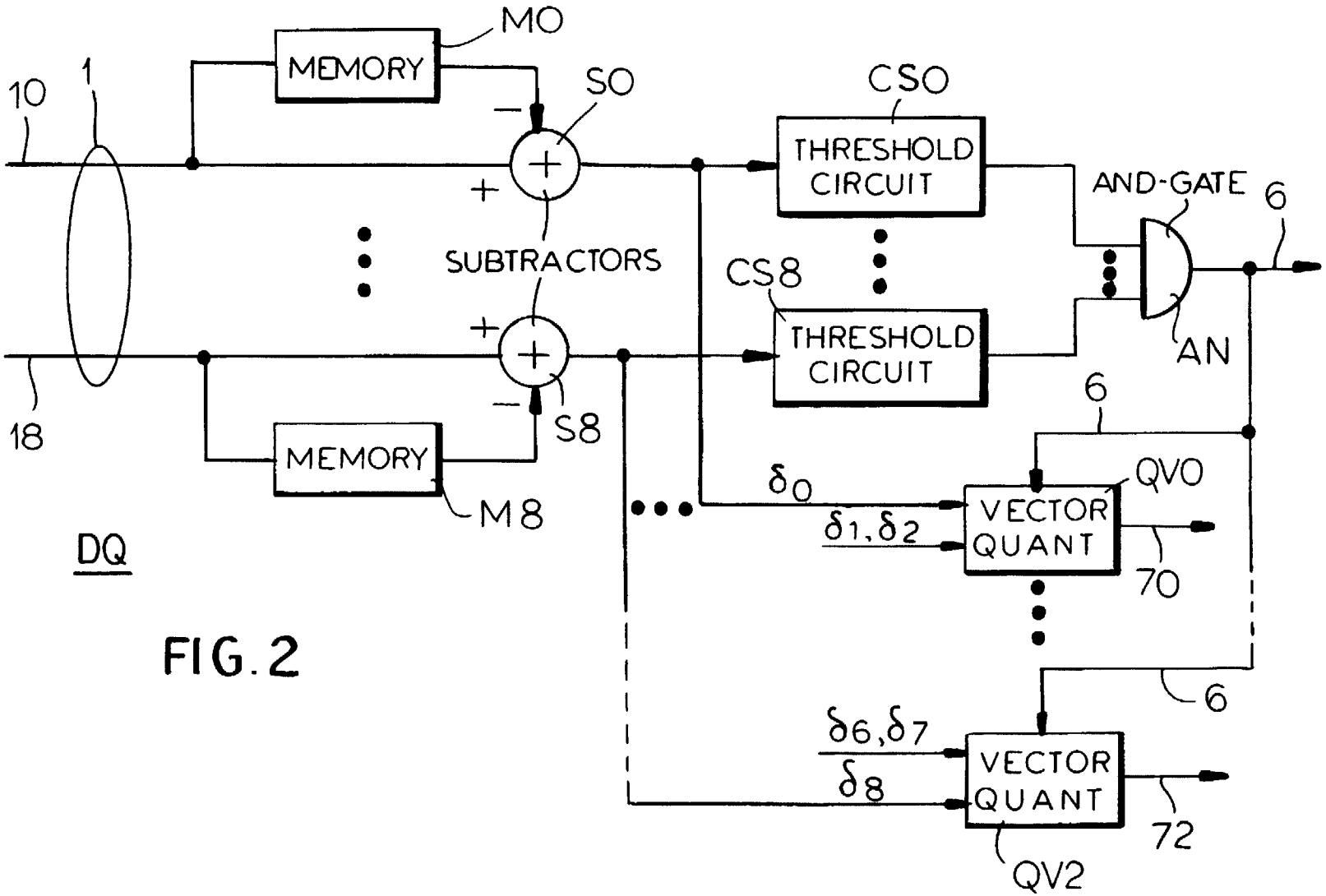
FIG. 2 is a block diagram of the quantization circuit according to the present invention.

FIG. 2 shows a possible circuit embodiment of the recognition circuit DQ, always with reference to the above mentioned numerical example. Indexes j(1,0)–j(1,8), present on lines 10–18 (making up all together connection 1) are provided to the positive input of respective subtractors S0 . . . S8, which receive at the negative input the indexes relevant to the previous frame, present on the output of memory elements M0 . . . M8. Differences $\delta_0$ . . . $\delta_8$ computed by S0 . . . S8 are supplied to threshold circuits CS0 . . . CS8 which carry out the comparison with thresholds +s and −s and generate an output signal whose logic value indicates whether or not the input value falls within the threshold interval. For instance, the signal is 1 if the input value falls within the threshold interval. The output signals of CS0 . . . CS8 are then provided to the circuit generating flag C, schematized by AND gate AN, the output of which is connection 6 (see also FIG. 1).

Differences $\delta_i$ are sent to vector quantization circuits QV0 . . . QV2, each of which receives three values $\delta_i$ and emits on output 70 . . . 72 one of the indexes j(4,0) . . . j(4,2). vector quantization circuits QV can be realized by read-only memories, addressed from the input value terns. To avoid storage of tables of values, the difference value distribution can be exploited and circuits QV can be realized with only one arithmetical unit which computes the indexes with a simple algorithm. For the sake of simplicity, refer to the table of value terns related to the first three differences:

| $\delta_0$ | $\delta_1$ | $\delta_2$ | j(4,0) |
|---|---|---|---|
| −2 | −2 | −2 | 0 |
| −2 | −2 | −1 | 1 |
| −2 | −2 | 0 | 2 |
| −2 | −2 | +1 | 3 |
| −2 | −2 | +2 | 4 |
| −2 | −1 | −2 | 5 |
| | . . . | | |
| +2 | +2 | +2 | 124 |

Considering that values $\delta_2$ are different row by row (except for the periodicity by groups of 5 rows), values $\delta_1$ change every 5 rows, and values $\delta_0$ change every 25 rows, index j(4,0) of a generic tern of values satisfies the relation $$j(4,0)=25(\delta_0+2)+5(\delta_1+2)+(\delta_2+2). \quad (1)$$

Value +2 (i.e. positive threshold value) is added to all values $\delta_i$ only to make positive all the values, since this facilitates computations. In general, if w=0, 1, 2 indicates the generic difference subset, the relation exists $$j(4,w)=25[\delta(0+3w)+2]+5[\delta(1+3w)+2]+[\delta(2+3w)+2] \quad (2)$$

of w. The relations (1) and (2) can be extended to the case of of w. It is immediate to extend (1) and (2) to the case of subsets with any number P of differences and to any value of |s|.

It is also to be noted that certain difference configurations, if scarcely probable, can be neglected, thus increasing the recognition capacity of transmission errors.

Figure 3:
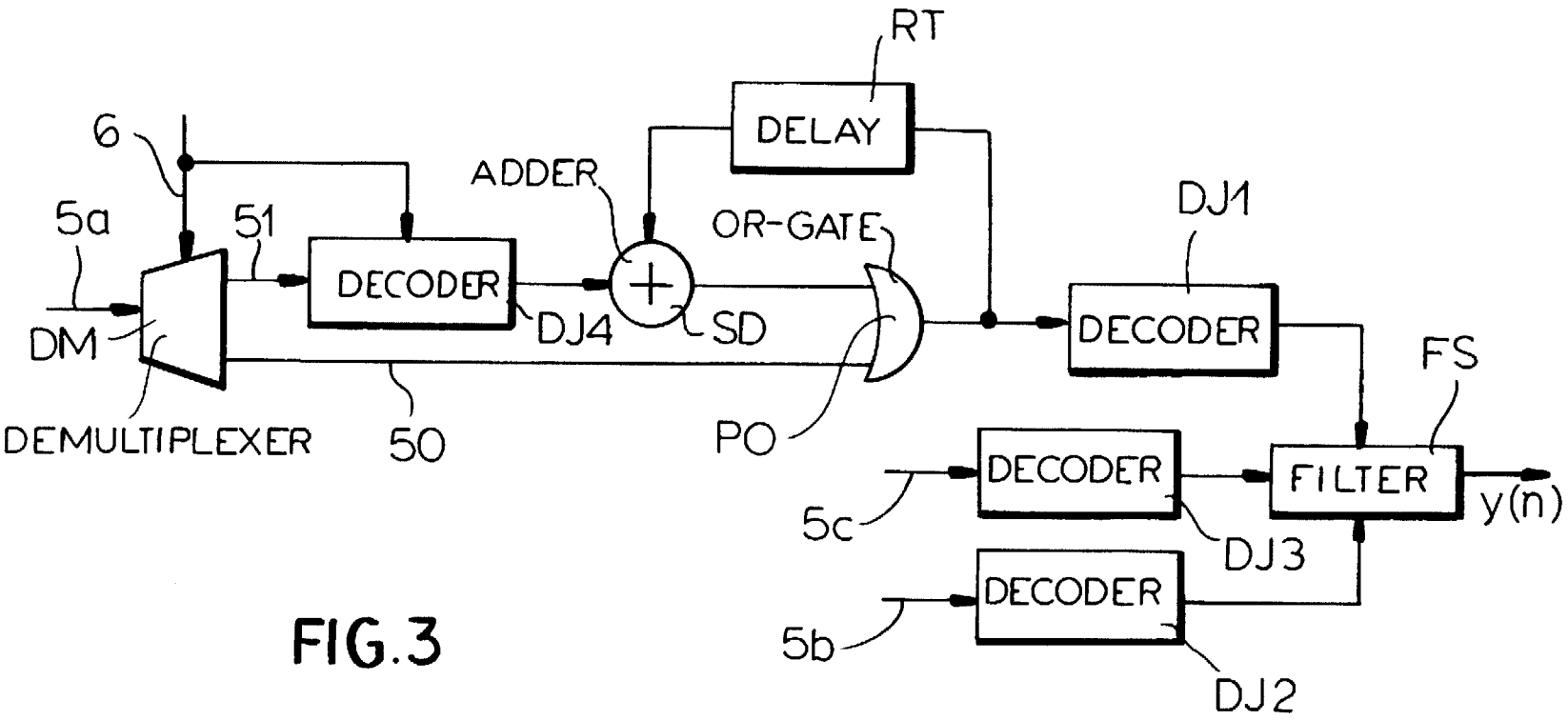
FIG. 3 is a diagram of the receiver.

FIG. 3 is a receiver block diagram. The receiver comprises a filtering system or synthesizer FS which imposes onto an excitation signal long-term and short-term spectral characteristics and generates a decoded digital signal y(n).

The parameters representing short-term and long-term spectral characteristics and the excitation are supplied to FS by respective decoders DJ1, DJ2, DJ3 which decode the proper bit groups of the coded signal, present on wire groups 5a, 5b, 5c of connection 5.

For reconstructing short-term synthesis parameters, it must be taken into account that information transmitted by the coder is different depending on whether it concerns a highly correlated speech period or not. Decoder DJ1 must therefore receive either directly the information coming from CV (in the case of a non correlated signal) or information processed to take into account the further quantization undergone at the coder in case of a correlated signal. For this purpose, a demultiplexer DM, controlled by flag C, supplies the signals present on wires 5a either on output 50 connected to decoder DJ1 (if C=0) or on output 51 connected to decoder unit DJ4 (if C=1) which carry out inverse quantization to that carried out by the vector quantization units QV0–QV2 (FIG. 2), and then reconstructs differences $\delta_i$. Depending on the structure of vector quantization unit QV, and decoder DJ4 will read the values in suitable tables or will perform the inverse algorithm to that above described. In this second case it is immediate to see that a generic tern of differences is obtained from index j(4,w) according to relations $$\delta(0+3w)=int[j(4,w)\cdot 0.04]$$

$$\delta(1+3w)=int\{[j(4,w)-25\cdot\delta(0+3w)]\cdot 0.2\} \quad (3)$$

$$\delta(2+3w)=j(4,w)-25\cdot\delta(0+3w)-5\cdot\delta(1+3w)$$

where "int" indicates the integer part of the quantity in brackets, and multiplications by 0.04 and 0.02 avoid carrying out the divisions by 25 and by 5. Also relations (3) must be computed at each frame for all the terns of values. To the values given by (3), −2 (i.e. −s) to take into account the scaling introduced at the coder. Reconstructed differences are added in adders SD is added to the values of indexes $j_1$ relevant to the previous frame, present at output of delay elements RT, thereby providing the indexes $j_1$ relevant to current frame. Outputs of adders SD are then connected to DJ1 through an OR gate PO, connected also to wires 50.

It is obvious that what described has been given only by way of non limiting example and that variations and modifications are possible without going out of the scope of the invention. Thus, even if reference has been made to quantization of short-term analysis parameters, the invention can be applied as an alternative or in addition to other types of parameters, in particular to those of long-term analysis, even if in these ones the correlation are less important and the advantages are therefore less marked. Furthermore, the difference quantization tables may be different for the various groups of differences. The particular quantization of speech periods with a high correlation can also be used in coders in which different coding strategies are provided depending on whether the sound is voiced or unvoiced.

I claim:

1. A method of speech signal digital coding which comprises the steps of:

converting a speech signal into a sequence of digital samples divided into frames of a preset number of samples; and submitting said digital samples to a spectral analysis for generating at least a group of spectral parameters which are quantized and transformed into a first set of indexes ($j_1$), wherein at each frame, during a coding phase, speech periods with a high correlation are recognized starting from the indexes of the first set and, for these periods, said first set of indexes ($j_1$) is converted into a second set of indexes ($j_4$) coded with a number of bits lower than that necessary for coding the first set, and the second set of indexes ($j_4$) is inserted into the coded signal, together with a signalling indicating that conversion has taken place, while for other periods the first set of indexes is inserted into the coded signal.

2. The method according to claim 1 wherein differences are computed between the indexes ($j_1$) of the first set generated for a current frame and those generated at a previous frame; absolute values of said differences are compared with a threshold; a flag (C) is generated constituting said signalling and having a present logic value, which indicates high correlation periods, when all absolute values lie in an interval of values limited by the threshold; and, for periods with a high correlation, said differences are divided into groups and vector quantization of respective groups is carried out, generating the second set of indexes ($j_4$).

3. The method according to claim 2 which comprises a decoding phase in which said spectral parameters are reconstructed and the reconstructed parameters are supplied to units synthesizing a decoded signal, the spectral parameters being directly reconstructed starting from a coded signal received if said flag (C) has a logic value complementary to the preset value and, if flag (C) has the preset logic value, the received signal is subjected to an inverse quantization for reconstructing differences between indexes representative of parameters of a current frame and of a previous frame, and the first set of indexes is reconstructed starting from these differences.

4. The method according to claim 1 wherein said spectral parameters are at least the representative parameters of speech signal short-term correlation.

5. The method according to claim 1 wherein the indexes ($j_4$) of the second set are directly computed at each frame, starting from difference values in each group, without storing quantization tables.

6. A device for speech signal digital coding, comprising means (AN, TR) for converting a speech signal into a sequence of digital samples and for dividing the sequence into frames comprising a preset number of samples, means (ABT, ALT) for spectral analysis of samples in said frames and quantization of parameters obtained as a result of spectral analysis, the means for the spectral analysis generating at each frame at least a first set of indexes ($j_1$) representing a value of the parameters in that frame, and means (CV) for generating a coded signal containing information relevant to said parameters, said device comprising, on a coding side:

means (DQ) for: recognizing, starting from the indexes ($j_1$) of said first set, frames in which the speech signal presents a high correlation; converting, for presenting a high correlation frame, the first set of indexes ($j_1$) into a second set of indexes ($j_4$), coded with a number of bits lower than that necessary for coding the indexes of the first set; and generating and transmitting to a decoder a signalling indicating that conversion has taken place; and means (MX) for supplying, in the frames presenting a high correlation, the means for generating (CV) with the second set of indexes in place of the first set of indexes.

7. The device according to claim 6 wherein the means (DQ) for recognizing frames with a high correlation comprise:

means (S0 . . . S8) for computing values of the differences between each index of the first set ($j_1$) and the value assumed by the same index at the previous frame;

means (CS0 . . . CS8) for comparing an absolute value of each difference with a threshold and generating signals by logic value of which indicates whether the absolute value has exceeded the threshold or not;

means (PA), receiving the signals generated by the means for comparing and emitting a flag which has a preset logic value when all output signals of the comparison means have the same logic value indicting that the threshold has not been exceeded, said flag being inserted into the coded signal and constituting said signalling; and vector quantization means (QV0 . . . QV2), enabled by said flag when it has the preset logic value, for vector quantization of groups of differences, generating the aforesaid second set of indexes.

8. The device according to claim 7, further comprising, on a decoding side, means (DM), controlled by said flag, which supply the coded information relevant to said parameters either to units (DJ4, RT, SD) for reconstructing the first set of indexes ($j_1$) and supplying the reconstructed set to units (DJ1) for parameter reconstruction, if said flag presents the preset logic value, or directly to the units (DJ1) for parameter reconstruction, if the flag presents the logic value complementary to the preset one.

9. The device according to claim 6 wherein the vector quantization means (QV0 . . . QV2) are made up of a single computing unit which directly computes the index representing individual difference groups starting from respective input values, without storing quantization tables.

10. The device according to claim 9 wherein the units (DJ4, RT, SD) for reconstructing the first set of indexes comprise means (DJ4) for reconstructing differences between the indexes of the first set relevant to a current frame and to a previous frame, and means (SD, RT) for storing said indexes relevant to a previous frame and adding them to the reconstructed differences, for reconstructing the indexes of the first set relevant to the current frame.

11. The device according to claim 6, characterized in that the spectral analysis means are means for short-term analysis of a linear prediction coder.

* * * * *